US006578719B1

(12) United States Patent
Finn

(10) Patent No.: US 6,578,719 B1
(45) Date of Patent: Jun. 17, 2003

(54) GOLF CLUB SUPPORT DEVICE

(76) Inventor: Francis James Finn, 15 Baker Pl., West Roxbury, MA (US) 02132

( * ) Notice: Subject to any disclaimer, the term of this patent is extended or adjusted under 35 U.S.C. 154(b) by 0 days.

(21) Appl. No.: 10/062,332

(22) Filed: Feb. 4, 2002

(51) Int. Cl.[7] ..... A47F 7/00
(52) U.S. Cl. ..... 211/70.2; 248/156; 473/282
(58) Field of Search ..... 211/70.2, 68, 70.8, 211/60.1; 248/156; 473/282

(56) References Cited

U.S. PATENT DOCUMENTS 1,443,230 A * 1/1923 Luckett
2,275,870 A * 3/1942 Sheldon
2,453,565 A * 11/1948 Barden
2,720,249 A * 10/1955 Peterson
3,076,557 A * 2/1963 Husted et al.
4,071,062 A * 1/1978 Ianetta ..... 248/156 X
5,080,239 A * 1/1992 Rowland ..... 211/70.2
5,417,334 A * 5/1995 Wu ..... 211/702
5,474,191 A * 12/1995 Bergeron et al. ..... 211/70.2
6,383,088 B1 * 5/2002 Kershner ..... 211/70.2 X

* cited by examiner

*Primary Examiner*—Robert W. Gibson, Jr.
(74) *Attorney, Agent, or Firm*—Joseph H. Killion

(57) ABSTRACT

An improved golf club support is disclosed which comprises an elongated shaft having an upper end portion and a lower end portion. A handle is provided connected to the upper end elongated shaft whereby a golfer may grasp the improved golf club support and insert it into the ground. A ground penetrating spike is disclosed connected to the lower end of the elongated shaft and a golf club support is attached to the upper portion of the improved golf club support at a height to support a golf club placed within it. An upright support is disclosed which is annularly disposed around the elongated shaft and extends outwardly from the elongated shaft and supports the improved golf club support in the upright position.

4 Claims, 2 Drawing Sheets

GOLF CLUB SUPPORT DEVICE

BACKGROUND OF INVENTION

There are a number of devices for supporting golf clubs and other golf accessories.

One example of such a device is shown in U.S. Pat. No. 5,873,471 (Ruggeri) which teaches a portable golf club support comprised of a steel rod, a rotatable club support and a flared lower end which assists the user in pressing the device into the ground.

Another device is disclosed in U.S. Pat. No. 5,467,980 (Weisenstein) which teaches a device having a point at one end thereof for piercing the ground and at the other end thereof a head having a u-shaped section perpendicular to the main frame for supporting a golf club.

U.S. Pat. No. 5,390,916 (Govoni) discloses a combination golf club holder and hook section to support a club, in the example, a wedge.

U.S. Pat. No. 5,285,990 (Engel) teaches a golf club rest with a mechanism to attach the golf club rest to the golf bag.

U.S. Pat. No. 5,149,087 (Thompson Jr.) teaches a golf club rest which includes a turf repair device on the piercing end.

Presently some seventy percent or more of golfers utilize carts which are generally not allowed to approach the green closely or are actually required to follow a certain path to minimize wear and tear on the area near the green. A golfer then must carry more than one club from the cart to where his ball lies. Often clubs become wet when laid down next to the green in wet conditions or are forgotten after the hole is completed, and the golfer has to go back to the hole and bend over to retrieve his club.

Also, there is a significant number of golfers with arthritic or other conditions which do not allow the golfer to manipulate a tricky golf support.

Prerequisites for an ideal golf club support include ease of use which includes light weight, durability, grip stability and a design which minimizes entanglement with the clubs or the golfbag or fouling of the clubs by wet conditions or freshly cut grass near the green. Additional desirable characteristic would include that it be aesthetically pleasing, simple to use and economical to manufacture.

SUMMARY OF INVENTION

I have discovered an improved golf club support device which comprises an elongated shaft means having an upper end portion and a lower end portion. I prefer that the circumference of the elongated shaft means be such that it can be grasped and not merely held by the golfer's fingertips.

A handle means, preferably a substantially ball-shaped handle means, is connected to the upper end portion of the elongated shaft means whereby a golfer may grasp my improved golf support device and insert it into the ground. I prefer that the ball-shaped handle means be made from a rigid material, particularly wood, however, other materials such a thermoplastic or other foam may be utilized to adjust the density of the ball-shaped handle means to accommodate a golfer with an arthritic condition.

A ground-penetrating means is connected to the lower end of the elongated shaft means for penetrating the ground to a pre-determined depth. I prefer, a spike which penetrates the ground to a depth of six inches or more is utilized. Also preferably, but optionally, the spike has a series of grooves spiraling around the outside thereof which when the spike penetrates the ground assist in maintaining stability of my improved golf club support.

Golf club support means are connected to the elongated shaft means at a height whereby one or more golf clubs can be temporarily supported. Prefereably, but optionally the club support means can include means to support other golf paraphernalia such as golf towels, brushes etc.,. I prefer the golf club support means to extend outwardly and upwardly so that any golf club will not roll off. In the preferred embodiment I disclose an outwardly and upwardly extending hook means where there is more than one outwardly and outwardly extending hook in each club support means. A golf club can be supported on one of the hooks and a golf towel with a clip attached or other golf accessory can be hung from the other hook.

Upright supporting means are annularly disposed about and connecting to the elongated shaft means adjacent the ground penetrating means and extending outwardly form the elongated shaft means in a substantially circular foot portion thereof which, in use, contacts the ground and whereby the elongated shaft means is supported thereby in an upright position. I prefer the upright supporting means to be circular and to include a collar which extends upward from a lower end of said upright supporting means to an upper end thereof to further support the elongated shaft means in an upright position. I prefer that said upright supporting means define a hole therethroughfor the ground penetrating means to pass through and connect to the elongated shaft means. Other shapes of the upright supporting means are contemplated and anticipated.

Preferably, but optionally, a hook means is provided to detachably connect my improved golf club support to a golf bag so that it can be readily carried with the golf bag and kept from fouling with the clubs.

Before explaining one embodiment of my invention in detail, it is to be understood that the invention is not limited in its application to the details of construction and to the arrangements of the components set forth in the following description or illustrated in the drawings. My invention is capable of other embodiments and of being practiced and carried out in various ways. Also, it is understood that the phraseology and terminology employed herein are for the purpose of description and should not be regarded as limiting.

As such, those skilled in the art will appreciate that the conception, upon which the disclosure is based, may readily be utilized as the basis for designing other structures methods and systems for carrying out the several purposes of the present invention. It is important, therefore, that the claims be regarded as including such equivalent constructions insofar as they do not depart from the spirit and scope of my invention.

It is the object of my invention to provide an improved golf club support device which while including many of the advantages of the devices mentioned before also includes many novel features which have not been anticipated by any of the prior golf club support devices. My invention provides numerous advantages over those of the prior art.

It is an object of my invention to provide a improved golf club support device that can be easily handled and readily inserted into the ground by any golfer even one who suffers from arthritis.

It is an object of my invention that my improved golf club device can be readily fitted into or attached to a conventional golf bag and can be detached and reattached without fouling or snagging with the gear or the clubs.

It is another object of my invention that my improved golf club supporting device will be stable in use.

These and other objects of my invention will become apparent when viewed in light of the accompanying drawings and following detailed description.

BRIEF DESCRIPTION OF THE DRAWINGS

FIG. 1-A is an illustrative view of the connector used to attach my invention to a golf bag.

DETAILED DESCRIPTION OF THE DRAWINGS

Figure 1:
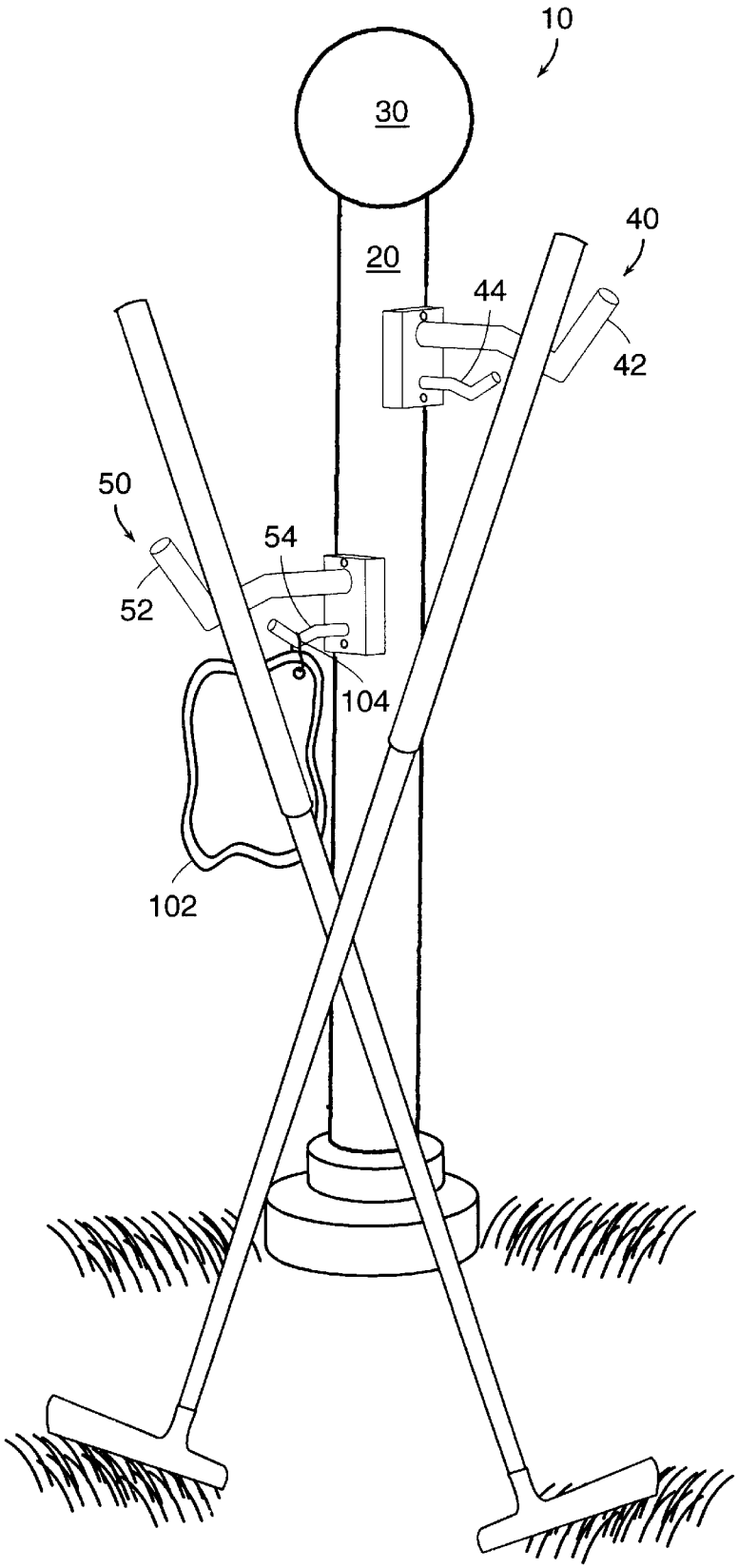
FIG. 1 is a perspective, illustrative view of my invention in use with golf clubs resting against it.
Figure 1A:
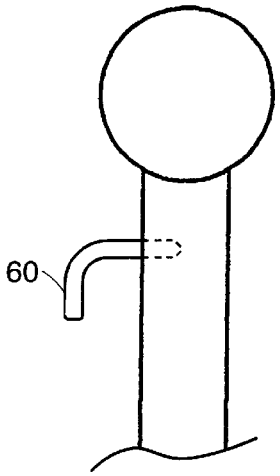
Figure 2:
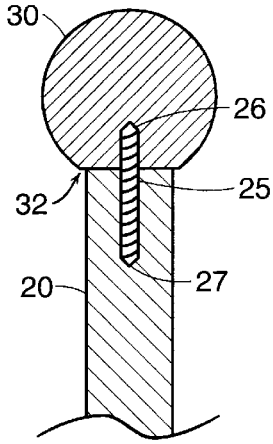
FIG. 2 is a side cut-away view along line 2 . . . 2 of the double headed screw means used to attache the handle means to the elongated shaft means of my invention.

Referring now in particular to the accompanying drawings, my improved golf club support device is generally indicated at 10 in FIG. 1 and includes shaft 20. In this preferred embodiment the shaft is made of wood and is of sufficient breath that it can be grasped by the golfer. Wood is an excellent material for this purpose and also for the fact that it is highly decorable and adaptable for the screwed in additions. Double ended screw 25 (FIG. 2) includes screw ends 26,27.

Screw end 26 is screwed first into ball-shaped handle 30 through flattened area 32. Ball-shaped handle 30 with double-ended screw 25 already in place is then screwed into wooden shaft 20 by screw end 27 so that the ball-shaped handle is securely joined with the wooden shaft 20.

Figure 4:
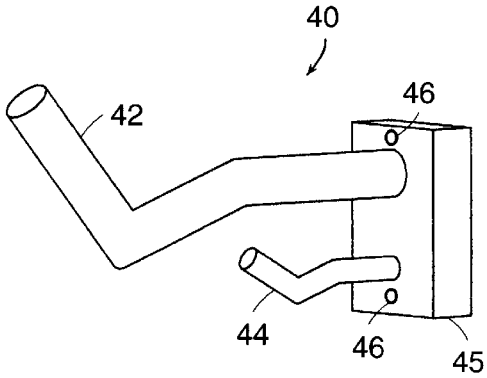
FIG. 4 is an illustrative perspective view of the club support means of my invention which depicts the "v-shaped " central portion thereof which secures the rested golf club.

Club support 40 (FIG. 4) including supporting hooks 42 and 44 is then screwed into the wooden shaft 20 through support plate 45 by screws 46, at a height which is optimal for supporting golf clubs when my improved golf club support device is inserted into the ground in use.

Another club support 50 including supporting hooks 52,54 through support plate 55(not shown) is inserted into wooden shaft 20 by screws 56 (not shown) preferably opposite club support 40.

Figure 3:
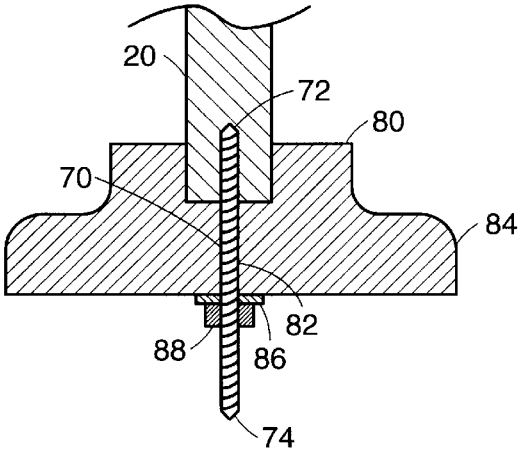
FIG. 3 is a cut-away side view along line 2 . . . 2 of the double headed screw means used to attach the elongated shaft through the club support means and to provide the ground-penetrating means of my invention.

Spike 70 (FIG. 3) includes spike ends 72.,74 Spike end 72 is screwed into wooden shaft 20.

Spike 70 is then inserted through annular opening 82 in rounded foot 80 having rounded lip 84 and washer 86 and nut 88 are placed over spike 70 and tightened into place holding rounded foot 80 in place against wooden shaft 20

FIG. 1-A shows hook 60 is screwed into wooden shaft 20 by screw end 62 arranged so that my improved golf club support device can be hooked onto a conventional golf bag when not in use.

In FIG. 1 a golf towel 102 is attached to a spring clip 104 which is then hooked over hook 54.

In use my improved golf club support device is removed from or detached from the golf bag and carried by the golfer together with any golf clubs to be used to the green area. My improved golf club support device allows the golfer to grasp the broadened shaft which distinguishes my improved golf club support device in the golfer's hand from the golf clubs and allows my invention not to become entangled with the golf clubs.

My improved golf club support device is then grasped by the golfer around the top ball-shaped handle and pushed into the ground up to the bottom of the upright support. Any excess golf clubs are then rested against my invention. After the golfer has made a shot with one of the clubs that may be rested against my invention and another club may be chosen for the next shot. The clubs do not become wet or fouled with dirt or wet grass.

If the golfer wishes he may utilize the towel attached as shown between shot to wipe a club. Upon completion of the hole the golfer grasps the ball shaped handle and withdraws my invention from the ground, walks over to the golf cart and places it in or reattaches my invention to the golf bag with the hooking device shown in the drawings.

Several modifications, changes and adoptions can be made by those skilled in the art without departing from the scope of my invention.

Therefore different means may be substituted by other types of design and are anticipated by this invention.

Accordingly, it is the intention of the inventor to include all such modifications which shall come within the true scope of this invention which is defined by the appended claims.

What is claimed is:

1. An improved golf club support device which comprises:

(a) elongated shaft means having an upper end portion and a lower end portion and further having a circumference sufficient so that a golfer may grasp it comfortably by hand;

(b) handle means connected to said upper end portion of said elongated shaft means whereby a golfer may grasp said elongated shaft means and insert it into the ground;

(c) an elongated spike means further defining a series of annular grooves arranged along said elongated spike means connected to said lower end portion of said elongated shaft means for penetrating the ground;

(d) upright support means annularly disposed about and connecting with said elongated shaft means adjacent said ground penetrating means including a broadened substantially flattened member defining a channel therein which extends therethrough and a spike means connected on and upper end to said elongated channel in said broadened substantially flattened member and extending to a lower end which extends substantially outwardly from said broadened substantially outwardly from said broadened flattened means whereby said improved golf club support device penetrates the earth and is held temporarily in place in said upright position from the ground;

(e) golf club support means connected to said elongated shaft means and arranged to support a golf club;

(f) a substantially ball-shaped member defining at the bottom a substantially flattened portion adaptable to said upper portion of said elongated shaft means whereby a golfer may readily grasp the improved golf club support device to insert it into the ground.

2. The improved golf club support device of claim 1 wherein said substantially ball-shaped member comprises a foamed material with adjustable density to accommodate users with arthritic conditions.

3. The improved golf club support device of claim 1 wherein said golf club support means further comprises:

(a) a support means attached on an inner end to said elongated shaft means and extending outward and upward from said elongated shaft means to an outward end whereby a golf club that is rested thereon will not slip off said support means.

4. The improved golf club support device of claim 1 which further comprises:

(a) hook means attached to said upper portion of said elongated shaft means and which extends outwardly and downwardly from said elongated shaft means whereby said improved golf club support device detachably engages a golf bag.

* * * * *